US006574834B2

(12) United States Patent
Fedon

(10) Patent No.: US 6,574,834 B2
(45) Date of Patent: Jun. 10, 2003

(54) PLASTIC HINGE FOR CASES, PARTICULARLY FOR GLASSES CASES

(75) Inventor: Callisto Fedon, Pieve di Cadore (IT)

(73) Assignee: Giorgio Fedon & Figli S.p.A., Vallesella Di Cadore (IT)

( * ) Notice: Subject to any disclaimer, the term of this patent is extended or adjusted under 35 U.S.C. 154(b) by 0 days.

(21) Appl. No.: 10/060,479

(22) Filed: Jan. 30, 2002

(65) Prior Publication Data

US 2002/0133906 A1 Sep. 26, 2002

(30) Foreign Application Priority Data

Mar. 21, 2001 (IT) ..... BL2001A0007

(51) Int. Cl.[7] ..... A45C 11/04; E05D 1/02

(52) U.S. Cl. ..... 16/225; 206/5; 206/6; 220/4.22; 220/829

(58) Field of Search ..... 16/225, 280, DIG. 13; 206/6, 5, 6.1; 220/4.22, 4.23, 4.24, 4.25, 826, 827, 829, 837, 838

(56) References Cited

U.S. PATENT DOCUMENTS 2,433,483 A * 12/1947 Root, Jr. ..... 206/6
2,565,441 A * 8/1951 Splaine et al. ..... 220/326
3,628,215 A * 12/1971 Everburg ..... 16/293
4,452,373 A * 6/1984 Pearce et al. ..... 220/4.22
5,730,310 A * 3/1998 Yoshihara ..... 220/835
6,173,476 B1 * 1/2001 Daoud ..... 16/323
6,398,017 B1 * 6/2002 Cafiero ..... 206/6

* cited by examiner

*Primary Examiner*—Anthony Knight
*Assistant Examiner*—Doug Hutton
(74) *Attorney, Agent, or Firm*—Morgan & Finnegan, LLP

(57) ABSTRACT

The present invention refers to a new manufacturing solution for a plastic hinge which is particularly advantageous for manufacturing rigid cases, especially glasses cases, by giving it an absolutely original appearance and by using an absolutely new technique through which a snap opening and closing of the case is obtained, even with the type of plastic hinge which is applied to any type of rigid half-shells.

The main characterizing feature of the present invention is to provide for the manufacturing of a single plastic element 10 to join the two half-shells (A, B) of a case, said element 10 consisting of two surfaces to be fixed to the edges of the half-shells (A, B) and joined each other longitudinally by an intermediate U-shaped surface 13 having a minimum thickness suitable for giving it the necessary flexibility, said surfaces being further hooked together by one or more springs aiming to flex said surfaces to make the half-shells (A, B) snapping in the opening or in the closing position.

5 Claims, 3 Drawing Sheets

PLASTIC HINGE FOR CASES, PARTICULARLY FOR GLASSES CASES

FIELD OF THE INVENTION

The present invention refers to a new manufacturing solution for a plastic hinge which is particularly advantageous for manufacturing rigid cases in general, and in particular rigid cases for glasses, by giving it an absolutely original appearance and by realising an absolutely new technique through which the case is snapped open and closed, even with the type of plastic hinge which is applied to any type of rigid half-shells.

The main characterising feature of the present invention is to provide for the manufacturing of a single plastic element to join the two half-shells of a case, said element consisting of two surfaces (or "wings") to be fixed to the edges of the half-shells and joined each other longitudinally by an intermediate U-shaped surface having a minimum thickness suitable for giving it the necessary flexibility, said surfaces being further hooked together by one or more springs aiming to, flex said surfaces to make the half-shells snapping in the opening or in the closing position.

PRIOR ART

The best way to protect and keep glasses or other fragile or valuable things is undoubtedly to put them in a rigid metal case of lidded box type, that generally consists of two half-shells, made on a preformed laminate, which are suitably covered by cloth, leather, simulated leather or similar materials and which are hinged each other at the edge opposite to the opening one.

The traditional technique of joining and hinging the two metal half-shells of said metal lidded box uses a normal hinge consisting of an element with a flat surface, to be fixed to the edge of a half-shell, provided with a series of small eyelets alternated with free spaces to be housed, aligned and hinged to the eyelets of the other part of the hinge, whose flat surface is fixed to the corresponding edge of the other shell to be joined and hinged.

Some cases of the above mentioned type, instead of being provided with a single hinge fixed along the whole back side of the case, have two distinct hinging elements, each of which is however provided with a flat surface to be fixed to the edge of the two half-shells and with an eyelet to be aligned and hinged to the other eyelet, with the same function of hinging.

The individual hinging elements are in turn fixed to the respective half-shell through seaming tabs realised on the metal edge of each case and suitably riveted after having gripped the flat surface of the hinge elements, which are then covered and made invisible by the covering fabric.

In the lidded metal boxes of the more accurate and prestigious type, the known hinging technique includes the application of one or more spring which, by hooking onto the respective and opposite edges of the hinge, give a useful snap action on opening and closing phases of the two half-shells.

The technique described up to now obviously carries out the necessary hinging action, as described above; however it has the disadvantage that the back edge of the case shows the row of hinging eyelets that inelegantly protrudes or at least shows up, affecting the overall appearance, often very accurate, with which a case of this type is finished.

Furthermore, as time passes, the above mentioned traditional hinges present rusting and noise problems that devalue the whole case.

An alternative technique for manufacturing lidded box cases has been introduced with the use of new plastics suitable for ensuring a sufficient stiffness to the two half-shells, as well for allowing that special configurations raised on their surfaces are created.

The joining and hinging of the half-shells of lidded-box cases made in plastic is generally allowed by the presence on an edge of these half-shells of special housings into which the surfaces supporting and fixing the hinging elements are inserted, while their eyelets must however be aligned to be hinged.

The final appearance resulting from this technique of joining and hinging the plastic half-shells, as the whole appearance in general, is certainly worsened when compared to the appearance of joining metal half-shells, as described above.

In any case, this alternative technique also has the disadvantage of not allowing the application of elastic systems that allow the plastic case to be snapped open and closed.

The introduction of new, stronger plastics has recently allowed to make hinges of plastic that, instead of being based on hinging a series of eyelets of two opposing aligned parts, are based on the use of a single hinging part made of one of these suitable plastics, comprising two surfaces to be fixed to the edges of the half-shells and joined by a thin intermediate surface that can be bent several times without breaking.

This improved hinging technique certainly ensures a better appearance for the back of the case, even if it does not allow elastic systems to be provided, however, for snapping the two half-shells open and closed.

What is more, this technique has never been used to join a pair of metal half-shells, since these half-shells do not provide for suitable recesses to house and to anchor said plastic hinge.

All these problems and others can be solved by a plastic hinge providing for a continuous longitudinal bend in the middle, which gives a new and original appearance to the back of the case, especially if used on metal half-shells of the highest quality, as well as ensuring a perfect operation for the hinging system that is complete with a snap opening and closing action.

In fact, the main purpose of the present invention is to allow the manufacturing of a back surface of a rigid lidded case having an appearance free of an unattractive visible row of back hinging rings, since it is provided with one or more continuous portions of a linear hinging element which can be applied especially to a pair of metal half-shells.

Another purpose of the present invention is to allow the manufacturing of rigid, lidded cases provided with one or more linear hinges, which however allow a closing and opening snap of its half-shells.

A further purpose of the present invention is to be able to apply the same type of linear hinge both to metal half-shells and to plastic ones, ensuring however, even over a period of time, both the quality and precision of the appearance and the functionality, silence and snap action of the hinge.

Last, but not least purpose of the present invention is to reduce to a minimum the parts that make up the hinge, reducing the costs of production and of providing the hinges to the half-shells of the case, thus realising a rigid lidded case that is both precise in appearance and provided with a hinge which is simple to make and apply.

SUMMARY

A plastic hinge for cases, especially for glasses cases, is disclosed, which is made of a single element, made of a suitable plastic material, suitable for joining the half-shells of a case. Said single element consists of two flat surfaces for fixing and joining the back edges of the half-shells and of an intermediate U-shaped surface for flexing said flat surfaces and is provided with teeth to anchor one or more springs that give it a closing stability and a snap movement.

BRIEF DESCRIPTION OF THE DRAWINGS

These and other purposes have been perfectly met by manufacturing the present invention, as it can be seen from the following description of one of its embodiments, which is only an indicative and not limiting one, disclosed with reference to the enclosed seven schematic figures shown by the enclosed two sheets of drawing, where.

Throughout the figures, like reference numerals refer to like parts.

DETAILED DESCRIPTION OF THE INVENTION

Figure 1:
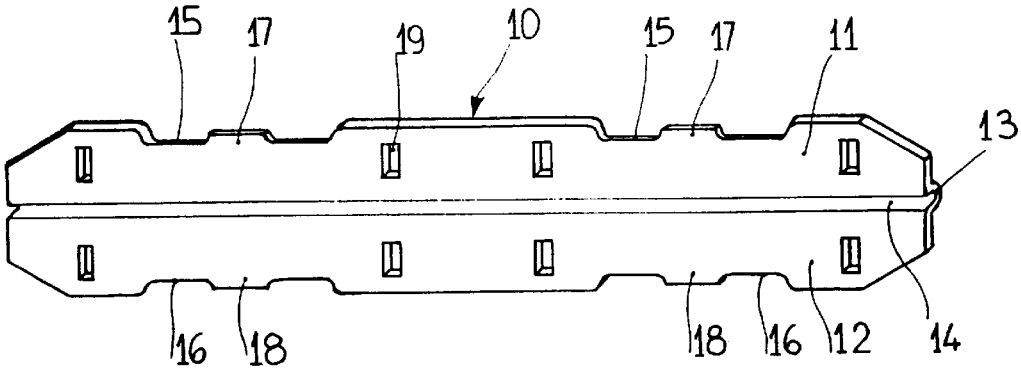
FIG. 1 of sheet 1 shows a perspective view of a linear plastic hinge, made according to the invention, for joining with a hinge the half-shells of a rigid lidded case.

A linear hinge 10 comprises two surfaces (11, 12), placed against each other on the same plane and joined by an intermediate linear and continuous "U"-shaped surface 13, which provides for a linear and continuous internal gap 14.

Each edge of the surfaces (11, 12) is provided with two pairs of recesses (15, 16) from which teeth 17 and 18 protrude.

A series of through holes 19, for example rectangular or square in shape, is made in the surfaces (11, 12) to help their fixing to the edges of the half-shells to be joined and hinged.

Figure 3:
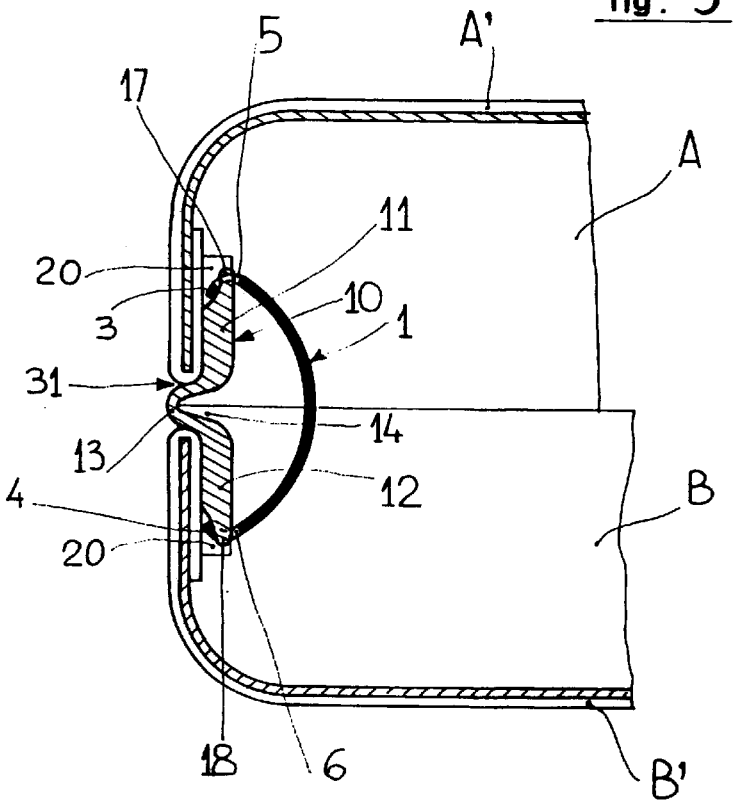
FIG. 3 shows a partial, cross sectional view of a pair of half-shells making up a rigid case or a lidded case, joined by the linear hinge of FIG. 1 and provided with the elastic device of FIG. 2, said half-shells being shown in their mutual closed position.
Figure 4:
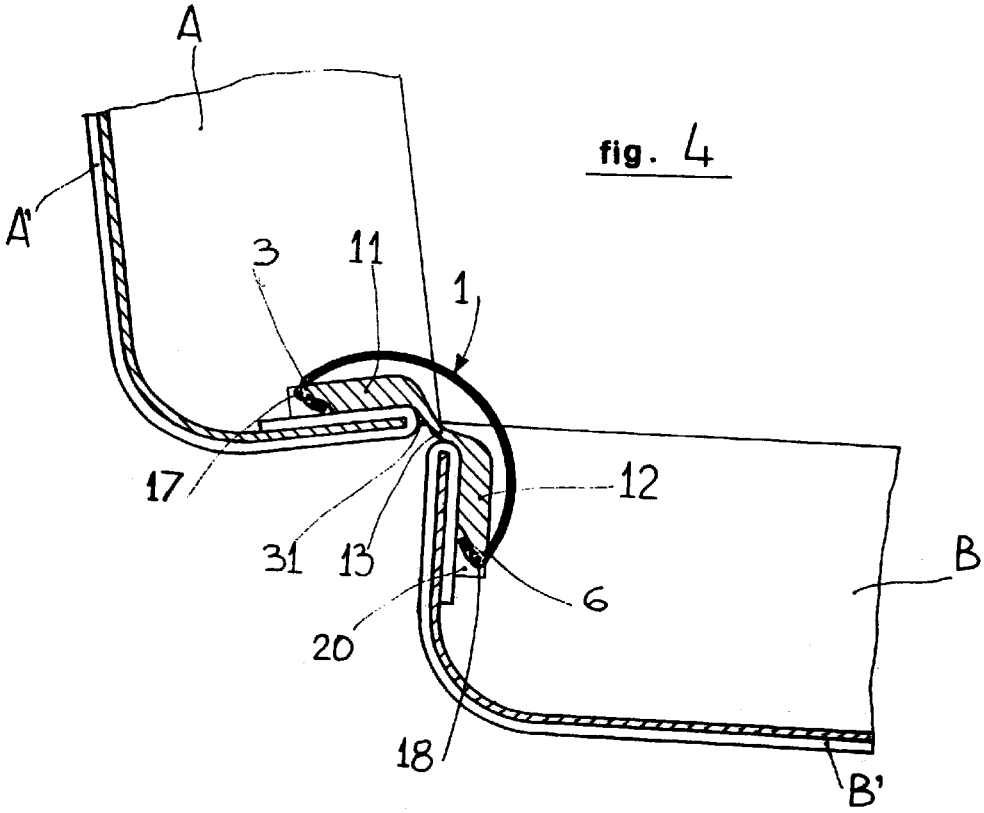
FIG. 4 shows a partial, cross sectional view of the pair of half-shells of FIG. 3 where the upper half-shell is in open position with respect to the position of the lower half-shell.

Preferably, the teeth (17, 18) are manufactured thinner than the thickness of the surfaces 11 and 12, thus producing a rear space or gap 20, as shown in FIGS. 3 and 4.

This hinge 10 is made, for example, by injection moulding with a suitable plastics that allows to realise the bend 13, preferably "U" shaped and having a thickness which is thinner than that of the remaining surfaces (11, 12), but which is however sufficient to allow the reciprocal and continuous movement of the surfaces (11, 12) over a period of time without producing cracks or breakage.

An elastic strip 1 is formed with half-cylinder shaped side surfaces 2 whose ends (3, 4) are bent radially, the edges of the bent ends (3, 4) being provided with axial through holes (5, 6) which are slot-shaped.

Having thus described briefly the two parts of the present in the following how they are assembled and how they work is summarised, also with reference to how the above mentioned purposes are achieved.

According to a traditional technique, a pair of half-shells (A, B) to be joined together to make a rigid lidded-box case to hold, for example, glasses is produced in a metal laminate 30, suitably punched and shaped into the shape for the required model.

These half-shells (A, B) are then covered on the outside, as usual, with fabric, simulated leather or other finishing material (A', B') according to tradition, while in their back edge a slight gap 31 is made that is designed to take half of the width of the fold 13 of the hinge 10, as shown in FIG. 3.

Figure 5:
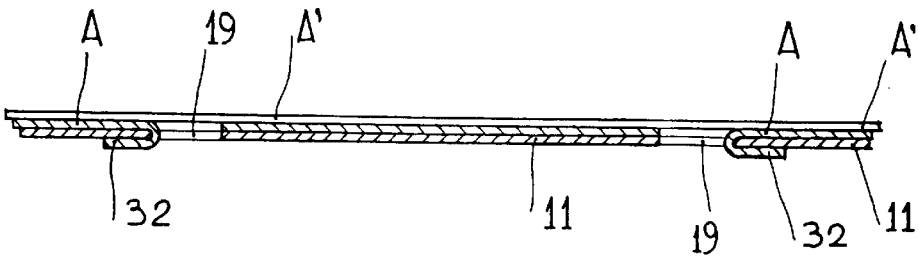
FIG. 5 of sheet 2 shows a longitudinal sectional view of a flat part of the hinge edge of a metal half-shell, linked to a flat part of the edge of the surface of the hinging element of FIG. 1.

These rear edges of the half-shells A and B are then provided with traditional foldable tabs 32 suitable to fit into the holes 19 of the hinge 10 before being bent onto themselves to grip on these edges of the two surfaces (11, 12) of the hinge 10, as shown in FIG. 5.

A pair of springs 1 is applied to the hinge 10 by hooking its bent ends (3, 4) into the recesses (15, 16) of this hinge 10, so that the teeth (17, 18) of the hinge 10 fit into the respective holes (5, 6) of each spring 1, while the bent edges (3, 4) of the spring 1 go into the rear spaces 20 made behind the teeth (17, 18).

Since the side surface 2 of the spring 1 has a half-cylindrical shape and the distance between the recesses (15, 16) positioned at the sides of the teeth (17, 18) is greater than the diameter of the springs 1, the binding of these springs 1 on the teeth (17, 18) determines the stretching of these springs 1, whose reaction is a tendency to move together the two surfaces (11, 12) of the hinge 10 by making them rotate on their joining part 13 to reduce the size of the flared space 14.

Since, however, surfaces (11, 12) of the hinge 10 are integral with the rear edges of the half-shells (A, B), the reaction of the spring 1 gives a thrust or snap closing of these half-shells (A, B), as shown in FIG. 3, ensuring that the glasses or other items positioned inside the case are kept better, according to one of the above specified purposes.

The upper half-shell A can open with a suitable manual effort overcoming the reaction of the spring 1 until going beyond the dead point where the distance between the opposed teeth (17, 18) is at a maximum and this distance decreases due also to the effect of the recessing or of the movement inside of the surfaces 2 with respect to the tip of the bend 13.

Being gone beyond this dead point, the reaction of the spring 1 tends to push the half-shell A to its maximum aperture, as shown in FIG. 4, thus triggering the snap-opening action.

In the closing phase, a force suitable to overcome the action of the spring 1 aiming to keep the upper half-shell A open is put on up to go beyond the above mentioned dead point and to be able to use the reaction of the spring 1 which aims to make the half-shell A snapping closed onto the below half-shell B, thus achieving another of the above mentioned purposes.

In view of the above, a rigid case in the form of a lidded box comprising open or closed half-shells (A, B) has a continuous longitudinal hinging part 13 of the hinge 10 that is an improved appearance for metal and plastic cases. Since hinge 10 can be made in plastic of any colour, this external continuous element 13 can offer a further opportunity for colour combinations with the remaining covering on the half-shells (A, B).

The novelty and decorative originality of the continuous external element 13 of the hinge 10 applied to half-shells (A, B) is subject matter of a simultaneous application for an international industrial design.

Figure 6:
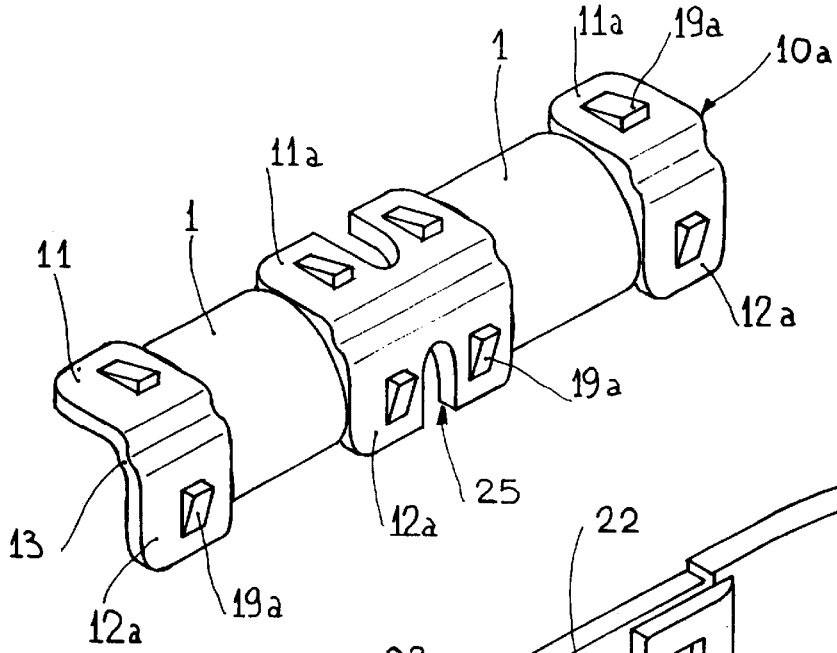
FIG. 6 shows a perspective view of a further embodiment of a hinge suitable to be applied to a pair of plastic half-shells.
Figure 7:
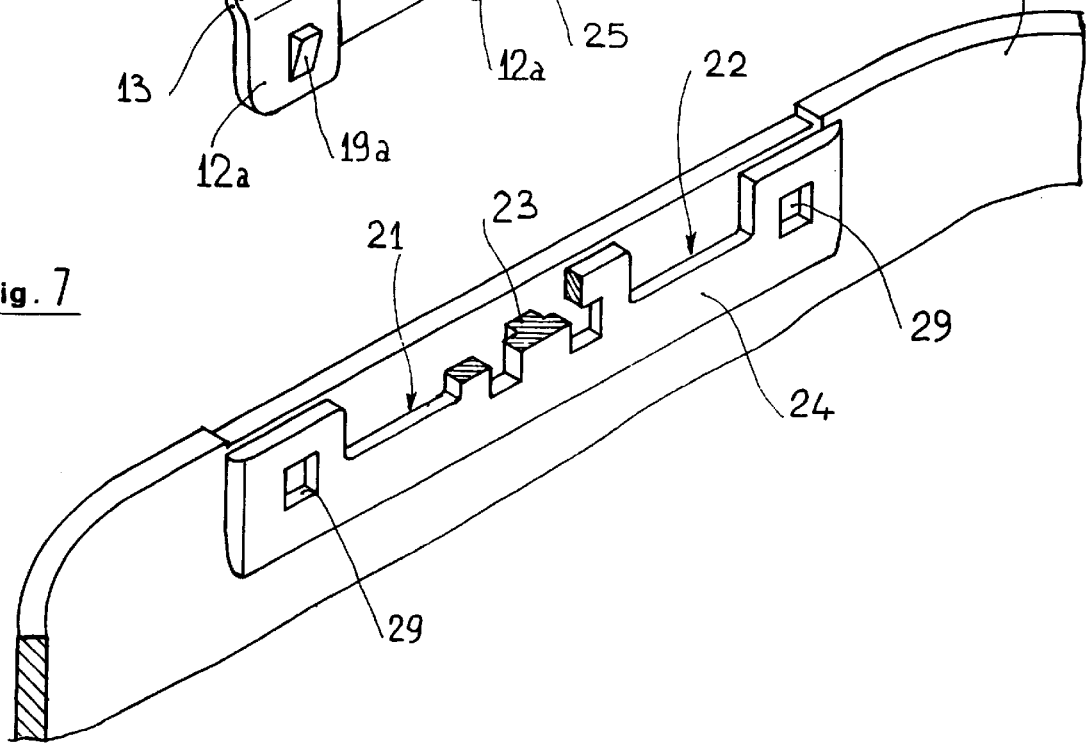
FIG. 7 shows a perspective view of a part of a half-shell, to the edge of which the hinge of FIG. 6 can be applied.

With reference to FIGS. 6 and 7, as already stated, a first possibility of a different use of the above hinge is disclosed, which is suitable also for connecting a pair of plastic half-shells.

More in detail, according to the embodiment shown by FIGS. 6 and 7, a hinge 10*a* comprises plane surfaces (11*a*, 12*a*) provided with inclined protrusions 19*a* instead of with the through holes 19 shown by FIG. 1.

Figure 2:
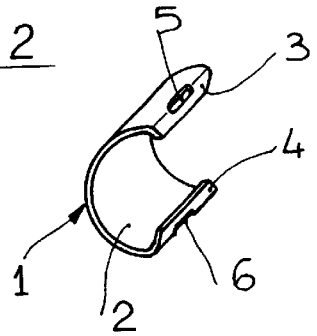
FIG. 2 shows a perspective view of an elastic element to be combined with the hinge of FIG. 1 to allow a snap opening and closing of the half-shells.

In FIG. 6 the hinge 10*a* is shown completely open and in any case it is provided with a pair of half-cylindrical springs 1 (FIG. 2), fixed as provided above with reference to the hinge 10, to make easier the opening, the closing and the snap movements of the plastic half-shells to which the springs are connected.

With particular reference to FIG. 7, it appears that the edge of the half-shell B1 wherein the hinge 10*a* is housed is provided with a pair of pockets (21, 22) divided by a stiffening wall 23 and that the external wall 24 of said pockets (21, 22) provides for through holes 21 wherein the inclined protrusions 19*a* are positioned when, for example, surface 12*a* is inserted into pockets (21, 22).

To allow the stiffening wall 23 to be present, the central portion of the hinge 10*a* is provided with hollows 25.

Of course, the manufacturing solution disclosed above is to be considered, as already stated, only as an indication and not in any way binding.

In fact it is possible, for example, to realise cases for jewellery or other items by using hinges provided with a single pair of recesses (15, 16) and of teeth (17, 18) for fixing a single spring 1; on the same way it is possible to provide for hinges 10 provided with a different number of fixing holes 19 and/or having another shape.

Furthermore, it is also possible, for example, to connect plastic half-shells (A1, B1) by using hinges 10 provided with through holes 19 on their surfaces 11 and 12 and by providing for inclined protrusions 19*a* in place of through holes 29.

This and other similar modifications or adaptations are to be considered as coming within the originality of the invention which is claimed.

What is claimed is:

1. A hinge for an eyeglass case made of a single plastic element that joins two half-shells of said case, comprising:

two flat surfaces joined to back edges of said half-shells, said flat surfaces having teeth that anchor one or more springs that give said hinge closing stability and snap movement; and a U-shaped surface that is integral to said two flat surfaces, said U-shaped surface intermediate said two flat surfaces.

2. A hinge according to claim 1, including at least one pair of recesses on said flat surfaces, each pair of recesses being adjacent one of said teeth, each said tooth having a thickness that is less than that of said adjacent pair of recesses, whereby a rear space is formed.

3. A hinge according to claim 1, including a series of through holes on said flat surfaces, each said through hole securing a foldable tab, each said through hole preferably having a rectangular or square shape.

4. A hinge according to claim 1, each said spring including a lateral surface having a half-cylindrical shape with radially bent ends, each said end having a slot-shaped through hole.

5. A hinge according to claim 1, wherein each said spring is secured to said hinge by inserting said teeth into slot-shaped holes formed at opposing ends of said spring.

* * * * *